United States Patent [19]

Breer, II

[11] 3,977,112

[45] Aug. 31, 1976

[54] DISPLAY DEVICE

[76] Inventor: Carl Breer, II, 1315 Second Ave., New York, N.Y. 10021

[22] Filed: Jan. 22, 1975

[21] Appl. No.: 542,959

Related U.S. Application Data

[63] Continuation-in-part of Ser. No. 524,547, Nov. 18, 1974, abandoned.

[52] U.S. Cl. ..... 40/152; 40/10 D

[51] Int. Cl.[2] ..... G09F 1/12

[58] Field of Search ..... 40/152.1, 128, 152; 248/467

[56] References Cited

UNITED STATES PATENTS

| | | | |
|---|---|---|---|
| 2,081,095 | 5/1937 | Mull | 40/128 X |
| 2,747,311 | 5/1956 | Fulmer | 40/156 |
| 2,860,437 | 11/1958 | Carroll | 40/152 |
| 2,961,789 | 11/1960 | Hughes | 40/152 |
| 3,128,072 | 4/1964 | Shibata | 248/467 |
| 3,694,947 | 10/1972 | Mukai | 40/152 |

*Primary Examiner*—Louis G. Mancene
*Assistant Examiner*—Wenceslao J. Contreras
*Attorney, Agent, or Firm*—Daniel Jay Tick

[57] ABSTRACT

A display device consists of a plate-like sheet of rigid transparent material having a pair of spaced opposite parallel edges. The sheet is bent in the area of each of the edges along lines parallel to and spaced from the edges to form a pair of lips. Each of the lips extends at a predetermined angle with the sheet in the area of a corresponding one of the edges. Each angle opens toward the other. Adhesive is provided on corresponding surfaces of the lips.

5 Claims, 10 Drawing Figures

FIG.8
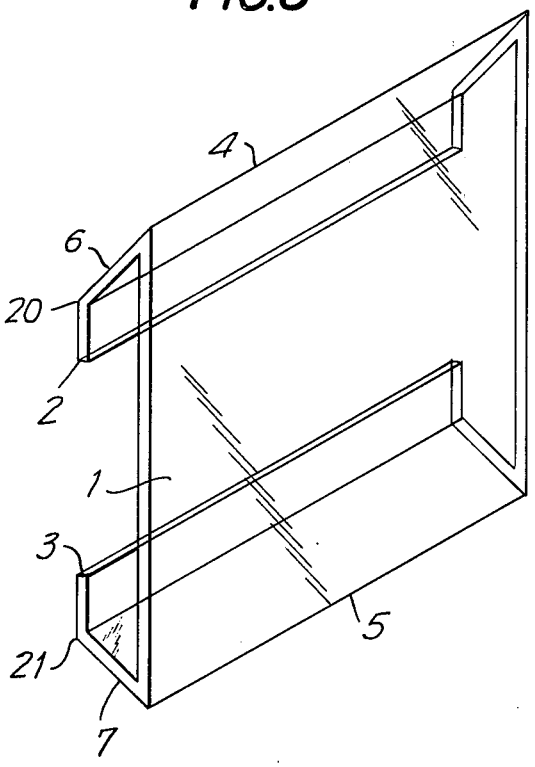
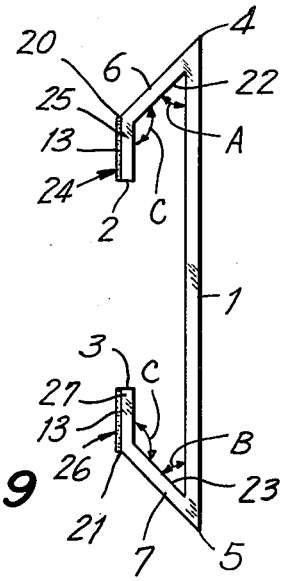
FIG.9
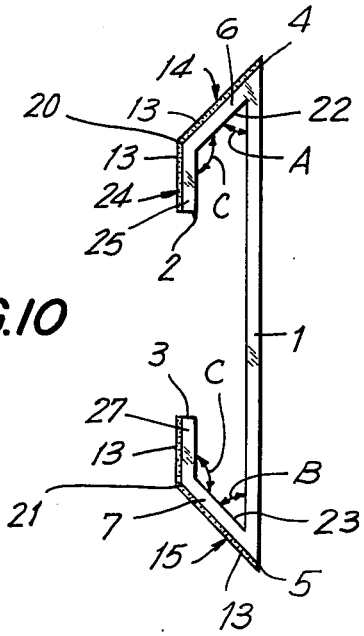
FIG.10

DISPLAY DEVICE

This application is a continuation - in - part of copending patent application Ser. No. 524,547, filed Nov. 18, 1974, now abandoned for PICTURE DISPLAY DEVICE.

BACKGROUND OF THE INVENTION

The present invention relates to a display device.

The old fashioned way of displaying pictures, paintings, photographs, and the like, is by frames hung on substantially vertical surfaces such as walls and mounted in stands supported by substantially horizontal surfaces such as desks, tables, cabinets, and the like. Much room space is not utilized and constitutes blank space, which could be utilized to very good purpose to the enhancement of the attractiveness of the room and to greatly magnify the enjoyment of the room by those using it.

The principal object of the invention is to provide a display device of simple structure, which is inexpensive in manufacture and displays a picture, photograph, painting, or the like, clearly, distinctly and to maximum advantage. The display device of the invention may display an object of any suitable type such as, for example, a clock, barometer, thermometer, or the like, affixed to the display device by any suitable means such as, for example, adhesive.

An object of the invention is to provide a display device which is mounted in a room and removed therefrom with facility, convenience and rapidity without the need for hooks, or the like.

Another object of the invention is to provide a display device which is mountable in a room in manner which utilizes otherwise non-utilized room space and greatly enhances the attractiveness of a room.

Still another object of the invention is to provide a display device which is mountable on a ceiling and a wall joining the ceiling in the area of the line of juncture of the ceiling and wall, or on two adjoining walls in the area of the line of juncture thereof, or on a wall.

BRIEF SUMMARY OF THE INVENTION

In accordance with the invention, a display device comprises a plate-like sheet of substantially rigid transparent material having a pair of spaced opposite substantially parallel edges. The sheet is bent in the area of each of the edges along lines substantially parallel to and spaced from the edges to form a pair of lips. Each of the lips extends at a predetermined angle with the sheet of material in the area of a corresponding one of the edges. Each angle opens toward the other. Adhesive is provided on corresponding surfaces of the lips.

The adhesive is on the surfaces of the lips farthest from each other.

The lips are bent at either equal angles or different angles with the sheet.

The lips are bent at complementary angles with the sheet.

A pad of material is removably positioned against the sheet by the lips thereby maintaining a picture, or the like, in position between the pad and the sheet in a manner whereby the picture, or the like, is viewable through the surface of the sheet farthest from the lips when the device is affixed to a first surface via one of the lips and to a second surface meeting the first surface via the other of the lips.

The picture, or the like, is viewable through the surface of the sheet farthest from the lips when the device is affixed to a first surface via one of the lips and a second surface meeting the first surface, via the other of the lips.

In another embodiment of the invention, one of the lips is bent on itself along a line parallel to and intermediate the edge and the line at the juncture of the corresponding one of the lips and the remainder of the sheet to form a trough-like configuration opposite the other of the lips. The adhesive is on the surface of the lips of the trough-like configuration farthest from the sheet. In one modification, the lips of the trough-like configuration are at an obtuse angle with each other and at an obtuse angle with the sheet.

In a modification, the lips of the trough-like configuration are perpendicular to each other. One of the lips is perpendicular to the sheet and the other of the lips is parallel with the sheet.

In another modification, each of the lips of the display device is bent on itself along a line parallel to and intermediate the edge and the line at the juncture of the corresponding one of the lips and the remainder of the sheet to form a pair of trough-like configurations opposite each other and opening toward each other. The adhesive means is either on the surface of the lip of each of the trough-like configurations farthest from the sheet, or on the surface of each lip of each of the trough-like configurations farthest from each other and from the sheet. The lips of each of the trough-like configurations are at an obtuse angle with each other, one of the lips of each of the trough-like configurations being parallel with the sheet.

BRIEF DESCRIPTION OF THE DRAWING

In order that the invention may be readily carried into effect, it will now be described with reference to the accompanying drawing, wherein:

FIG. 8 is a perspective view of another modification of the embodiment of FIGS. 1 and 2;

FIG. 9 is a side view of the modification of FIG. 8; and

FIG. 10 is a side view of a modification of the embodiment of FIG. 8.

In the figures, the same components are identified by the same reference numerals.

DETAILED DESCRIPTION OF THE INVENTION

Figure 1:
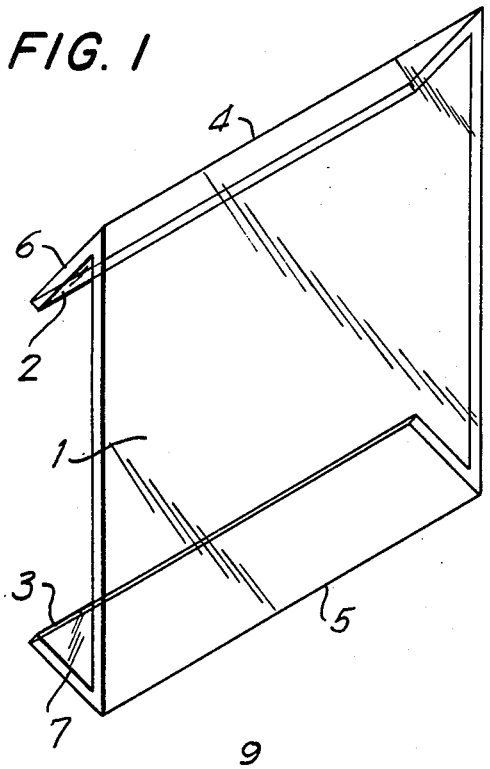
FIG. 1 is a perspective view of an embodiment of the display device of the invention.
Figure 2:
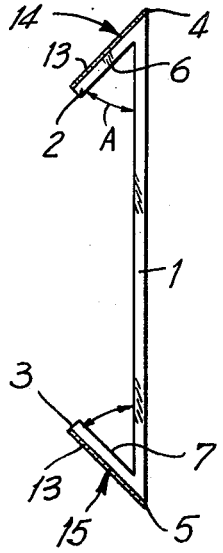
FIG. 2 is a side view of the embodiment of FIG. 1.

The display device of the invention comprises a plate-like sheet 1 of substantially rigid transparent material such as, for example, plastic of any suitable type. The sheet 1 is preferably of rectangular configuration.

The sheet 1 has a pair of spaced opposite substantially parallel edges 2 and 3 (FIGS. 1 to 3 and 5 to 7). The sheet 1 is bent in the area of each of the edges 2 and 3 along lines 4 and 5 substantially parallel to and spaced from said edges (FIGS. 1 to 3 and 5 to 7) to form a pair of lips 6 and 7 (FIGS. 1 to 3 and 5 to 7).

Each of the lips 6 and 7 extends at a predetermined angle with the sheet 1 in the area of a corresponding one of the edges 2 and 3 (FIGS. 1 to 3 and 5 to 7). Each angle opens toward the other. Thus, the lip 6 extends at an angle A with the sheet 1 in the area of the edge 2 and the lip 7 extends at an angle B with said sheet in the area of the edge 3 (FIGS. 2, 3, 5 and 7).

Figure 3:
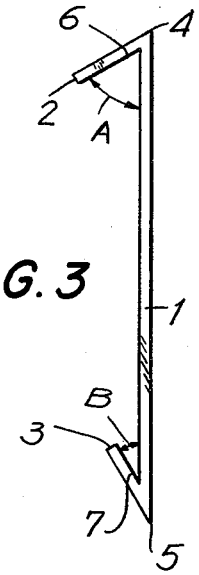
FIG. 3 is a side view of a modification of the embodiment of FIG. 1.
Figure 6:
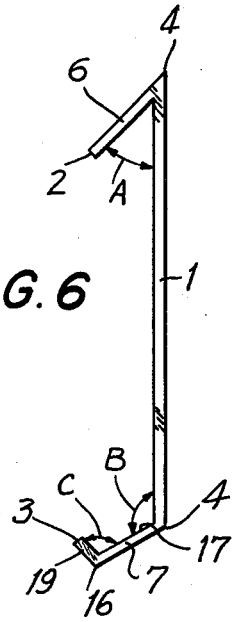
FIG. 6 is a side view of another embodiment of the display device of the invention.

The angles A and B may be equal, as shown in FIGS. 1, 2, 5 and 7, or different, as shown in FIGS. 3 and 6. In the embodiment of FIGS. 1, 2, 3 and 5, the angles A and B are complementary. In each of FIGS. 1, 2 and 5, the angle A equals the angle B equals 45°. In the modification of FIG. 3 the angle A plus the angle B equals 90°, so that the angle A may equal 30°and the angle B may equal 60°.

Figure 7:
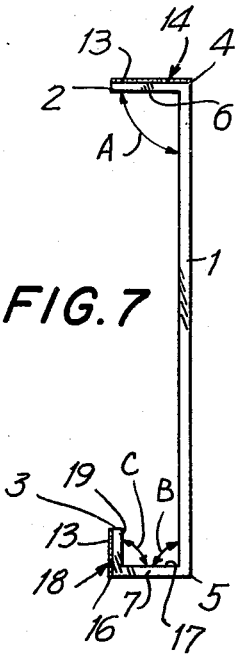
FIG. 7 is a side view of a modification of the embodiment of FIG. 6.

In the embodiment of FIGS. 6 and 7, the angles A and B are not complementary. In the embodiment of FIG. 6 the angle A is acute and the angle B is obtuse. In the modification of FIG. 7, the angle A equals the angle B equals 90°.

Figure 4:
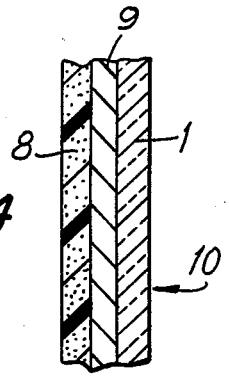
FIG. 4 is a cross-sectional view on an enlarged scale of the display device of the invention in use.
Figure 5:
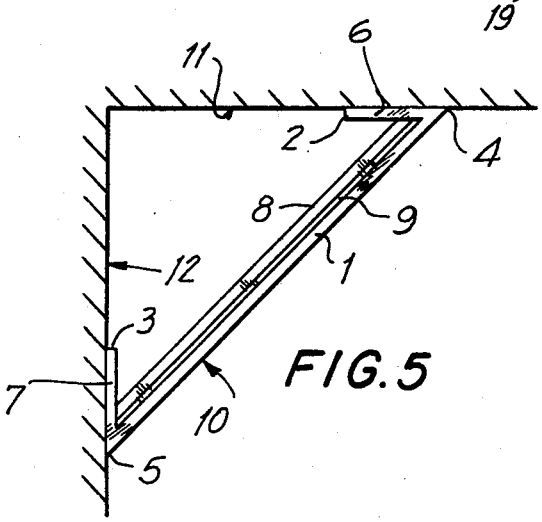
FIG. 5 is a side view of the display device of the invention mounted in a room.

As shown in FIGS. 4 and 5, the display device of the invention is used by the lips 6 and 7 positioning a pad 8 of any suitable material such as, for example, plastic foam, against the sheet 1. This maintains a picture, photograph, painting, or the like, 9, in position between the pad 8 and the sheet 1 in a manner whereby the picture is viewable through the surface 10 of the sheet farthest from the lips 6 and 7 when the display device is affixed to a first surface 11 such as, for example, a ceiling or wall, via the lip 6 and to a second surface 12 such as, for example, a wall, via the lip 7. The pad 8 may be rigid or flexible, as long as it permits the lips 6 and 7 to maintain the picture, or the like, wedged against the sheet of the display device.

Any suitable item or object such as, for example, a clock, barometer, thermometer, or the like, may be mounted on the sheet 1 of the display device by any suitable means, such as, for example, adhesive, and is viewable through the surface 10 of said sheet.

Adhesive of any suitable type such as, for example, self-adhesive or pressure-adhesive 13 (FIG. 2) is provided on corresponding surfaces 14 and 15 of the lips 6 and 7, respectively, farthest from each other. The lips 6 and 7 are affixed to the surfaces 11 and 12 via the adhesive 13.

The display device of the invention may be affixed, as shown in FIG. 5, to first and second surfaces 11 and 12 meeting each other as ceiling and wall, or as adjoining walls.

In the embodiment of FIGS. 6 and 7, the lip 7 is bent on itself along a line 16 parallel to and intermediate the edge 3 and the line 4 at the juncture of said lip and the remainder of the sheet 1 to form a trough-like configuration or trough 17 opposite the other lip 6. In the embodiment of FIGS. 6 and 7, the adhesive 13 is provided on the surface 14 of the lip 6 and on the surface 18 of the trough 17 farthest from the sheet 1, as shown in FIG. 7.

In the embodiment of FIG. 6, the lips 7 and 19 of the trough 17 are at an obtuse angle C with each other and at an obtuse angle B with the sheet 1. In the modification of FIG. 7, the lips 7 and 19 of the trough 17 are perpendicular to each other. The lip 7 is perpendicular to the sheet 1 and the lip 19 is parallel with said sheet.

In the embodiment of FIGS. 8, 9 and 10, each of the lips 6 and 7 is bent on itself along a line 20 and 21, respectively, parallel to and intermediate the edge 2 and 3, respectively, and the line 4 and 5, respectively, at the juncture of the lips 6 and 7, respectively, and the remainder of the sheet 1 to form a pair of trough-like configurations or troughs 22 and 23, respectively, opposite each other and opening toward each other, as shown in FIGS. 8, 9 and 10.

In the embodiment of FIG. 8, the adhesive 13 is provided on the surface 24 of the lip 25 of the trough 22 farthest from the sheet 1 and on the surface 26 of the lip 27 of the trough 23 farthest from said sheet. In the modification of FIG. 10, the adhesive 13 is provided on the surface 14 of the lip 6 and on the surface 24 of the lip 25 of the trough 22 and on the surface 15 of the lip 7 and on the surface 26 of the lip 27 of the trough 23.

In the embodiment of FIGs. 8, 9 and 10, the lips 6 and 25 of the trough 22 are at an obtuse angle C of 135° with each other and the lips 7 and 27 of the trough 23 are at an obtuse angle C of 135° with each other. Since each of the angles A and B equals 45° in the embodiment of FIGS. 8, 9 and 10, the lips 25 and 27 of the troughs 22 and 23 are parallel with the sheet 1.

The display device of FIGs. 8, 9 and 10 may thus be affixed to a single surface such as, for example, a wall. The display device of FIG. 10 may be affixed to either a single surface such as, for example, a wall or to first and second surfaces, such as the surfaces 11 and 12, meeting each other as ceiling and wall, or as adjoining walls.

While the invention has been described by means of specific examples and in specific embodiments, I do not wish to be limited thereto, for obvious modifications will occur to those skilled in the art without departing from the spirit and scope of the invention.

I claim:

1. A display device, comprising a plate-like sheet of substantially rigid transparent material having a pair of spaced opposite substantially parallel edges and bent in the area of each of said edges along lines substantially parallel to and spaced from said edges to form a pair of lips each extending at a predetermined angle with the sheet of material in the area of a corresponding one of said edges, each angle opening toward the other, each of the lips being bent on itself along a line parallel to and intermediate the edge and the line at the juncture of the corresponding one of the lips and the remainder of the sheet to form a pair of trough-like configurations opposite each other and opening toward each other; and adhesive means on corresponding surfaces of the lips.

2. A display device as claimed in claim 1, wherein the adhesive means is on the surface of the lip of each of the trough-like configurations farthest from the sheet.

3. A display device as claimed in claim 1, wherein the adhesive means is on the surface of each lip of each of the trough-like configurations farthest from each other and from the sheet.

4. A display device as claimed in claim 1, wherein the lips of each of the trough-like configurations are at an obtuse angle with each other, one of the lips of each of the trough-like configurations being parallel with the sheet.

5. A display device, comprising a plate-like sheet of substantially rigid transparent material having a pair of spaced opposite substantially parallel edges and bent in the area of each of said edges along lines substantially parallel to and spaced from said edges to form a pair of lips each extending at a predetermined angle with the sheet of material in the area of a corresponding one of said edges, each angle opening toward the other;

adhesive means on corresponding surfaces of the lips; and a pad of material removably positioned against the sheet by the lips thereby maintaining a picture, and the like, in position between the pad and the sheet in a manner whereby the picture, and the like, is viewable through the surface of the sheet farthest from the lips when the device is affixed to a first surface via one of the lips and to a second surface meeting the first surface via the other of the lips.

* * * * *